United States Patent [19]

Vitale

[11] Patent Number: 4,792,473

[45] Date of Patent: Dec. 20, 1988

[54] SELF ADHESIVE WALLBOARD TAPE

[75] Inventor: Ralph F. Vitale, East Haven, Conn.

[73] Assignee: Endura Tape, Inc., Clinton, Conn.

[21] Appl. No.: 925,226

[22] Filed: Oct. 31, 1986

[51] Int. Cl.[4] ..... B32B 7/06; B32B 7/12

[52] U.S. Cl. ..... 428/40; 428/137; 428/202; 428/138; 428/343; 428/906

[58] Field of Search ..... 428/40, 138, 202, 354, 428/906, 58, 61, 137, 343, 131; 52/417; 156/304.3

[56] References Cited

U.S. PATENT DOCUMENTS 4,041,201 8/1977 Wurker ..... 428/40

*Primary Examiner*—Alexander S. Thomas

*Attorney, Agent, or Firm*—DeLio & Associates

[57] ABSTRACT

A self adhesive wallboard tape comprising a substrate containing longitudinally spaced holes in the center of said substrate and an adhesive coating on one side of said substrate, the center portion of said substrate being adhesive free.

7 Claims, 1 Drawing Sheet

SELF ADHESIVE WALLBOARD TAPE

BACKGROUND OF THE INVENTION

This invention relates to a self adhesive tape and more particularly to a dry wallboard seam and corner tape.

Tapes of this type are used primarily in building construction and/or repair and the erection of dry walls. These tapes are usually applied to seal the seams between sections of wallboard on the flat wall surfaces or at corners.

There is currently a need to provide as total a seal as possible between sections of wallboard and to provide as smooth a covering as possible on butt corners of walls. Furthermore, such seal must be as flush as possible with the sections of the wallboard itself and must be strong enough so as to not release from the seam and bulge out. In corner applications, it is necessary that the corner seam be sealed totally with a material which will not bunch up or tear, thus breaking the seal. Such seal must also be unaffected by the long term environment found in typical areas of application.

In attempting to meet these requirements the prior art has used various approaches. The most common approach is to apply a bedding coat of gypsum compound directly over the seam where sections of wallboard meet, then to apply a tape over the coat of gypsum compound and then to apply one or more coats of gypsum compound over the tape.

This procedure requires several days to elapse before the wall is ready for painting, papering, or finishing. The time and labor costs involved increase the costs of the construction.

One of the principal advantages of this invention is the elimination of the need for the bedding coat of gypsum compound with the attendant savings in material and labor costs and time.

Using an open mesh fiber glass material to seal the seams between the sections of wallboard, as disclosed in U.S. Pat. No. 3,391,037 to McNulty, is also unsatisfactory because of the washboard like ridges typically resulting in practice when this open mesh fiber glass product is overcoated with the gypsum compound.

In the prior art there are devices which apply the gypsum compound and the tape simultaneously, but these devices are cumbersome to use and unreliable in operation.

Another problem encountered in using a current state of the art approach is that the adhesive on the tape sometimes tends to bleed out from the edges of the tape thus weakening the seal. Also, the adhesive coating on the tape tends to lessen the bond between the tape itself and the coat of gypsum compound applied over the tape to finish the point. This can result in the tape coming loose from the wall thus breaking the seal between the wallboard sections.

SUMMARY OF THE INVENTION

The present invention is a self adhesive wallboard tape comprising a substrate made of paper or other suitable material, an adhesive layer on one side and a release liner. The substrate is perforated in the center with longitudinally spaced holes. The adhesive is spaced so that the center portion of the tape is adhesive free. The tape is used to seal gaps between sections of wallboard.

The tape is applied directly over the seam where the sections of the wallboard meet and a coat of gypsum compound is applied over the tape. The perforations in the center of the tape allow the gypsum to pass through the tape and fill the gaps between the sections of wallboard, thus eliminating the need for the bedding coat of gypsum compound.

The lack of adhesive in the center of the tape allows the gypsum compound to bond the gypsum compound to the tape itself rather than to the adhesive.

The tape has a high long term resistance to peeling and a superior (initial) tack strength.

OBJECTS OF THE INVENTION

In view of the foregoing, one of the objects of the present invention is to provide a new and improved self adhesive composite material for sealing gaps between sections of wallboard.

Another object of the invention is to provide a new and improved self adhesive composite material with high long term resistance to peeling and with superior (initial) tack strength.

Still other objects and advantages of the invention will be apparent from the following application. The invention accordingly comprises a product possessing the features, properties and relation of components which will be exemplified in the product hereinafter described. The scope of the invention will be indicated in the claims.

BRIEF DESCRIPTION OF THE DRAWINGS

For full understanding of the invention, reference is had to the following description, taken in conjunction with the accompanying drawings, in which:

FIG. 3 is a perspective view similar to FIG. 1, showing an alternate embodiment of the invention.

DETAILED DESCRIPTION OF THE PREFERRED EMBODIMENT

Figure 1:
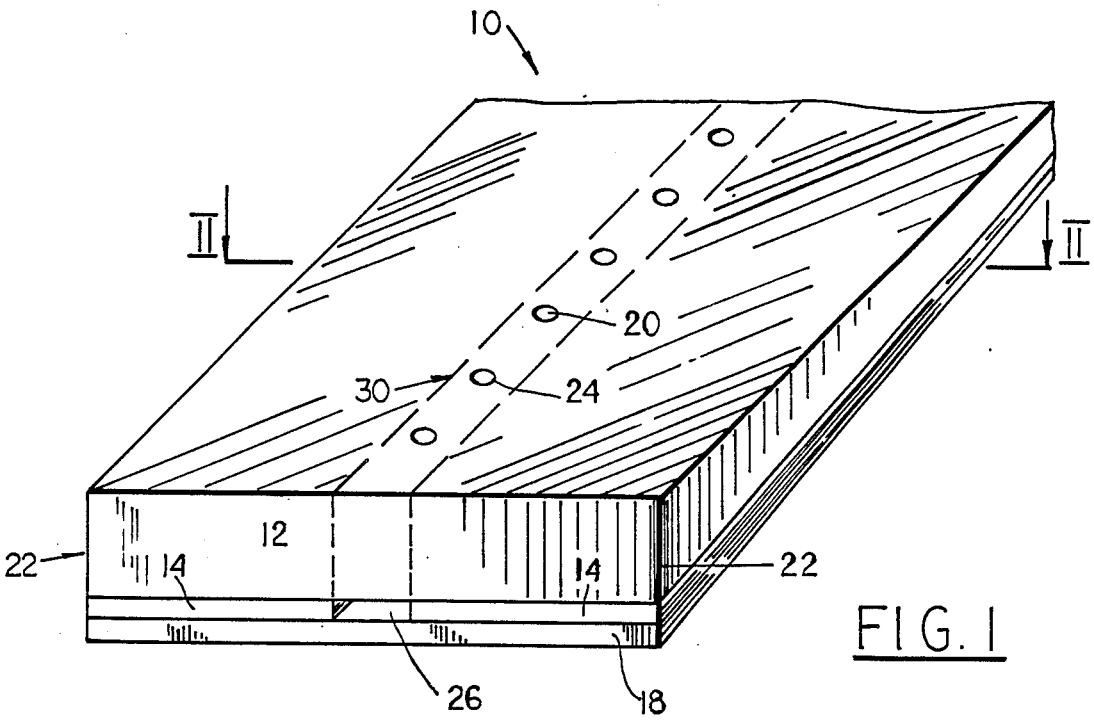
FIG. 1 is a perspective view of the tape according to the invention.
Figure 2:
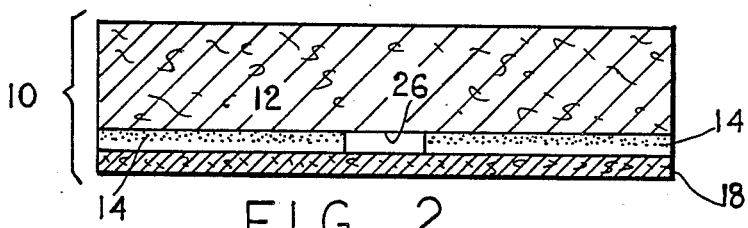
FIG. 2 is a cross sectional view taken along line II—II of FIG. 1.
Figure 7:
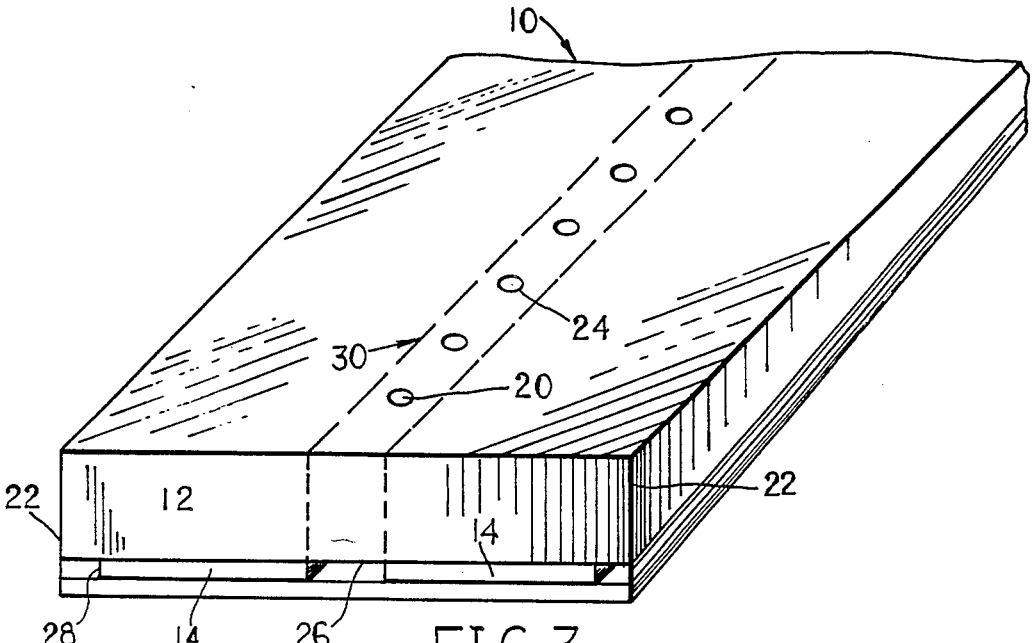

The product 10 of the instant invention is composed of three principal components: a substrate 12, an adhesive coating 14 and a peelable backing 18. The substrate is usually of thicknesses in the range of about 0.004 inch (0.1 mm) to about 0.02 inch (0.5 mm). The substrate can be several inches wide but is preferably about 1½ inches (38.1 mm) to about 2½ inches (63.5 mm) wide. This substrate can be of any suitable material such as fiberglass, woven material, plastic, paper and the like. When paper is employed as the substrate, it is often desirable to increase the strength of the paper in the area of the perforation by the addition of a fiber, such as plastic, fiber glass or the like. The strengthing must be such as not to affect adversely the surface of the paper substrate. Preferably, 100% bleached Kraft pulp paper with no ground wood pulp and no polychlorinated biphenyl is used as the substrate.

The paper is centrally and longitudinally perforated with a series of holes 20 the diameter of which can range from about 1/32 inch (0.8 mm) to about ¼ inch (9.5 mm) and is preferably in the range from about 1/16 inch (1.59 mm) to about 5/16 inch (7.9 mm). The space between the holes ranges from about 1/32 inch (0.8 mm) to about 1 inch (25.4 mm) and preferably from about 1/16 inch (1.59 mm) to about ¼ inch (6.35 mm). These perforations permit the overcoated gypsum compound to flow through the tape in sufficient quantity to fill any gaps between the sections of wallboard and to support and bond the tape itself to the gypsum compound. In addition, the perforations can be useful in aligning the tape in a suitable dispensing tool for easy application of the tape.

The spacing of the holes is important to maintain the integrity of the tape so that it will not tear during application or thereafter. The diameter of the holes is important to permit the optimum amount of gypsum compound to flow through the holes and into the gaps.

The adhesive coating or layer 14 is placed on one side of the substrate 12. This adhesive layer must be self adhesive and pressure sensitive and must have high (initial) tack to paper and high long term peel strength. To this end, it is contemplated that the adhesive will be an acrylic, i.e. an acrylic containing iso-octylacrylate/acrylic acid or the like.

By precisely adhering to the teaching of the present invention, the adhesive is not the limiting factor in the strength of the joint, as is the case in the prior art where the gypsum compound (bedding) was used to attach the tape to the underlying wallboard.

The adhesive is applied on one side of the substrate 12 starting at each edge 22 of the substrate or at a point up to about ¼ inch (6.35 mm) from said edge to the outside circumference 24 of the holes 20 or to a point 30 up to about ¼ inch (6.35 mm) from said outside circumference. In a preferred embodiment, the adhesive begins at a point 28 from about 0.005 inch (0.1 mm) to about 0.09 inch (22.9 mm) from said outside edges. In both instances, the center portion 26 of the substrate is adhesive free.

The adhesive coating 14 can have a thickness range of from about 0.0005 inch (0.01 mm) to about 0.01 inch (0.25 mm) and preferably about 0.002 inch (0.05 mm) to about 0.005 inch (0.13 mm), depending on whether the surfaces to be joined are smooth or even or irregular or rough. If both surfaces are smooth or even, a lesser thickness will suffice.

Spacing the adhesive away from the edges of the substrate eliminates adhesive rollover or bleed and results in improved unspooling of the tape and overcoating with gypsum compound. No adhesive attaches to the flat outside surfaces of the wallboard sections to mar their smoothness.

The release liner 18 is generally coated paper, usually as thin as is practical and is applied over the adhesive 14, thus facilitating the peel off or unspooling of the tape 10 when in roll form. This liner further releases freely from the tape. The release liner on the non-adhesive side must have a sufficient coefficient of friction in combination with the tape to maintain roll integrity both laterally and tangentially.

It will thus be seen that the objects set forth above among those made apparent from the preceeding description can be efficiently attained and since certain changes may be made in the above product without departing from the spirit and scope of the invention, it is intended that all matter contained in the above description shall be interpreted as illustrative and not of limiting sense. It is also to be understood that the following claims are intended to cover all of the generic and specific features of the invention herein described. Particularly, it is to be understood that, in the claims, ingredients or compounds recited in the singular are intended to include compatible mixtures of such ingredients wherever the sense permits.

I claim:

1. A self adhesive wallboard tape comprising:

a paper tape substrate suitable for bonding with gypsum compound and perforated with longitudinally spaced holes in about the center of said substrate, an adhesive coating on one side of said substrate spaced from a point beginning at each edge of said substrate to a point from about 0 inches (0 mm) to about ¼ inch (6.35 mm) from the outside circumference of said longitudinally spaced holes, whereby the center portion of said substrate is adhesive free.

2. The tape of claim 1 further defined in that the substrate is bleached Kraft paper from about 1.95 inches (49.5 mm) to about 2.03 inches (51.6 mm) wide and from about 0.004 inch (0.1 mm) to about 0.01 inch (0.25 mm) thick.

3. The tape of claim 2 further defined in that said holes are spaced from about 3/16 inch (4.8 mm) to about ¼ inch (6.35 mm) apart.

4. The tape of claim 3 further defined in that the diameter of said holes is from about 3/16 inch (4.8 mm) to about 5/16 inch (7.9 mm).

5. The tape of claim 1 further defined in that said adhesive is spaced from a point beginning from about 0.005 inch (0.1 mm) to about ¼ inch (6.35 mm) from each edge of said substrate to a point from about 0 inches (0 mm) to about ¼ inch (6.35 mm) from the outside circumference of said holes whereby a portion of each edge of the substrate and the center portion of the substrate are adhesive free.

6. The tape of claim 1 further defined in that the adhesive coating ranges in thickness from about 0.0005 inch (0.01 mm) to about 0.01 inch (0.25 mm).

7. The tape of claim 1 further defined in that a release liner is placed over the adhesive coating.

* * * * *

UNITED STATES PATENT AND TRADEMARK OFFICE

CERTIFICATE OF CORRECTION

PATENT NO. : 4,792,473

DATED : December 20, 1988

INVENTOR(S) : Ralph F. Vitale

It is certified that error appears in the above-identified patent and that said Letters Patent is hereby corrected as shown below:

Column 2, line 62, delete "¼" and substitute therefor --3/8--

Signed and Sealed this

Ninth Day of May, 1989

*Attest:*

DONALD J. QUIGG

*Attesting Officer*

*Commissioner of Patents and Trademarks*